US009909301B2

(12) United States Patent
Milne et al.

(10) Patent No.: US 9,909,301 B2
(45) Date of Patent: Mar. 6, 2018

(54) METHOD AND APPARATUS FOR MAKING A WATER DRAINAGE-PROMOTING WRAP

(75) Inventors: Robert Milne, Vancouver (CA); Martin Vido, St. James (BB)

(73) Assignee: OWENS CORNING INTELLECTUAL CAPITAL, LLC, Toledo, OH (US)

( * ) Notice: Subject to any disclaimer, the term of this patent is extended or adjusted under 35 U.S.C. 154(b) by 0 days.

(21) Appl. No.: 14/115,311

(22) PCT Filed: May 1, 2012

(86) PCT No.: PCT/CA2012/000411
§ 371 (c)(1),
(2), (4) Date: Jan. 27, 2014

(87) PCT Pub. No.: WO2012/149637
PCT Pub. Date: Nov. 8, 2012

(65) Prior Publication Data

US 2014/0134408 A1 May 15, 2014

Related U.S. Application Data

(60) Provisional application No. 61/482,426, filed on May 4, 2011.

(51) Int. Cl.
*B32B 3/10* (2006.01)
*E04B 1/62* (2006.01)
(Continued)

(52) U.S. Cl.
CPC ..... *E04B 1/625* (2013.01); *E04B 1/665* (2013.01); *E04D 12/002* (2013.01); *Y10T 428/24802* (2015.01)

(58) Field of Classification Search
CPC ..... E04B 1/624
See application file for complete search history.

(56) References Cited

U.S. PATENT DOCUMENTS 6,509,084 B2 * 1/2003 Sturtevant et al. ..... B05D 5/02 15/215
6,805,905 B2 † 10/2004 von Wolff et al.
(Continued)

FOREIGN PATENT DOCUMENTS

| | | |
|---|---|---|
| CA | 2597138 | 8/2006 |
| CN | 102114464 A † | 7/2011 |
| WO | 2009/105464 | 8/2009 |

OTHER PUBLICATIONS

Hardness of Rubber: Durometer http://www.rubbermill.com/PDFs/tech/durometer.pdf retrieved Jul. 6, 2015.*

*Primary Examiner* — Christopher Polley
(74) *Attorney, Agent, or Firm* — Calfee, Halter & Griswold LLP

(57) ABSTRACT

A method and apparatus for making a water drainage-promoting wrap for applications such as housewrap and roofing underlayment. A substrate, which may be breathable or non-breathable, is conveyed through a nip between a rotating sleeve and a roll, the sleeve having a plurality of apertures therein. A fluid resin composition is fed into the sleeve and is fed out through the apertures in the sleeve as it rotates and as the substrate moves through the nip, forming spaced-apart spacer elements on a face of the substrate. The spacer elements are then dried or cured.

1 Claim, 4 Drawing Sheets

(51) Int. Cl.
*E04B 1/66* (2006.01)
*E04D 12/00* (2006.01)

(56) References Cited

U.S. PATENT DOCUMENTS

| | | | | |
|---|---|---|---|---|
| 7,607,270 | B2 | 10/2009 | Ehrman | |
| 7,887,900 | B2 † | 2/2011 | DiPede | |
| 2003/0215594 | A1 * | 11/2003 | Hamdar et al. | 428/40.1 |
| 2004/0180195 | A1 | 9/2004 | Macuga | |
| 2004/0237462 | A1 | 12/2004 | Collins et al. | |
| 2007/0144110 | A1 | 6/2007 | Aalbers et al. | |
| 2008/0141604 | A1 * | 6/2008 | Arthurs et al. | 52/408 |

* cited by examiner
† cited by third party

FIG. 1
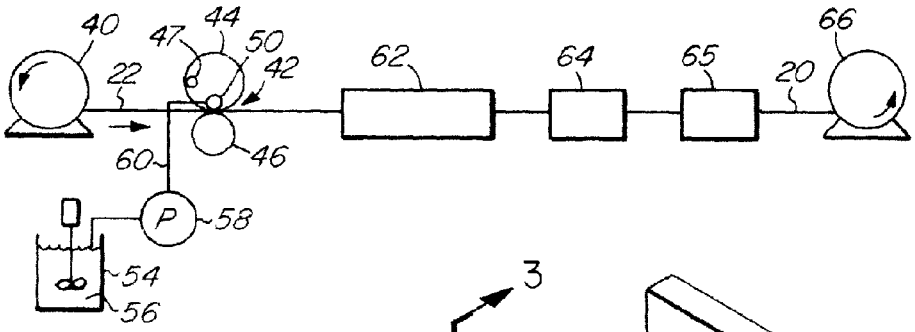
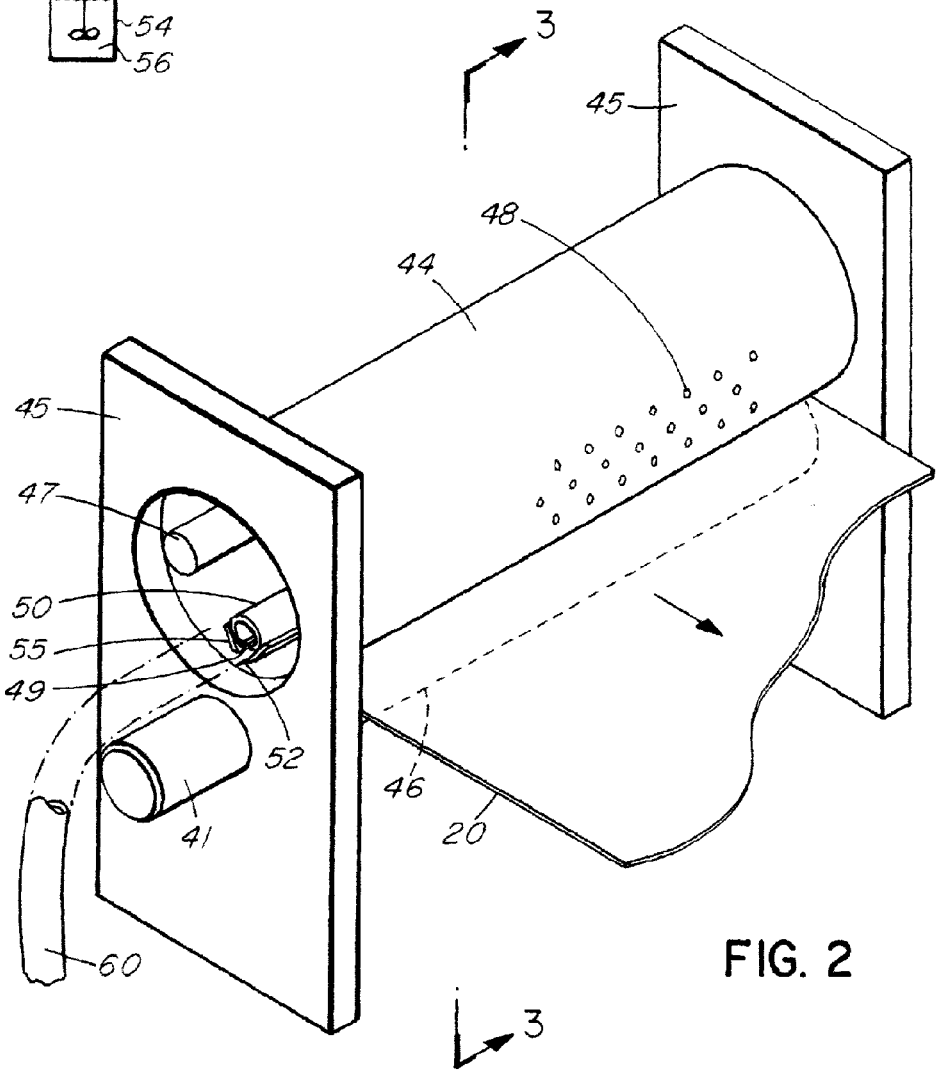
FIG. 2

METHOD AND APPARATUS FOR MAKING A WATER DRAINAGE-PROMOTING WRAP

CROSS-REFERENCE TO RELATED APPLICATION

This application claims the benefit of U.S. provisional application No. 61/482,426 filed May 4, 2011.

FIELD OF THE INVENTION

The invention pertains to wraps suitable for use as housewrap or roofing underlayment, in which the wrap facilitates water drainage within the wall or roof, and to methods and apparatus for making the wraps.

BACKGROUND OF THE INVENTION

It is common practice in the construction industry to apply a wrap that is resistant to penetration by liquid water and air in the construction of the exterior walls and roofs of building structures. Such wraps are commonly referred to as housewraps or roofing underlayments. Typically, housewraps and roofing underlayments are also breathable, i.e. permeable to water vapor, to help prevent the buildup of moisture within the walls and roof of a building, which can cause mold and rot and be highly damaging to the structure, though some roofing underlayments are non-breathable.

It is known to apply drainage-promoting means to such construction wraps. For example, Ehrman et al., U.S. Pat. No. 7,607,270, discloses a wrap comprising a weather-resistant membrane and a series of spaced-apart, elongate filament spacers bonded to the membrane and having depressions providing drainage paths.

The present invention is direct to improvements in drainage-promoting wraps and to methods and apparatus making them.

SUMMARY OF THE INVENTION

The invention provides a method of making a water drainage-promoting wrap for applications such as housewrap and roofing underlayment. A substrate, which may be breathable or non-breathable, is conveyed through a nip between a rotating sleeve and a roll, the sleeve having a plurality of apertures therein. A fluid resin composition is fed into the sleeve and is fed out through the apertures in the sleeve as the sleeve rotates and the substrate moves through the nip, forming a plurality of spaced-apart spacer elements on a face of the substrate. The spacer elements are then dried or cured. The invention also provides a wrap made according to the foregoing method.

The process permits the formation of intricate designs and patterns of spacer elements that can promote water drainage regardless of the orientation in which the wrap is installed. The process also permits the use of specialized resin formulations, for example formulations having very low surface energy to aid in water flow.

In the prior art, filament extrusion to form spacer elements is limited to the use of substrates with which the filament material is compatible in order for it to adhere. In the present invention, the flexibility in resin compositions and the manner of applying it to the substrate allows for a broader variety of substrates. Further, the invention permits the profile of rolls of the wrap to be managed by means of an appropriate spacer pattern selection in order to reduce buildup in the roll, permitting longer roll lengths with smaller diameters.

According to another embodiment, the invention provides an apparatus for making a water drainage-promoting wrap, comprising a rotatable, cylindrical sleeve having a plurality of apertures therein, the apertures being arranged for the flow of a fluid resin composition from the inside of the sleeve onto a substrate, which may be breathable or non-breathable, to form discrete, spaced-apart spacer elements on the face of the substrate; a rotatable roll, the sleeve and roll being arranged to form a nip for the passage of the substrate; means for feeding the substrate through the nip; a tray inside the sleeve for receiving the fluid resin composition, the tray being spaced from an inner surface of the sleeve and having an opening for release of the fluid resin composition; means for feeding the fluid resin composition to the tray; a doctor blade inside the sleeve in contact with the inner surface of the sleeve; and means for drying or curing the spacer elements on the substrate.

Further aspects of the invention and features of specific embodiments of the invention are described below.

BRIEF DESCRIPTION OF THE DRAWINGS

FIG. 1 is a schematic drawing of an embodiment of the process for making the wrap.

FIG. 2 is a perspective view of an embodiment of the apparatus for applying spacer elements.

DETAILED DESCRIPTION OF THE PREFERRED EMBODIMENTS

Figure 3:
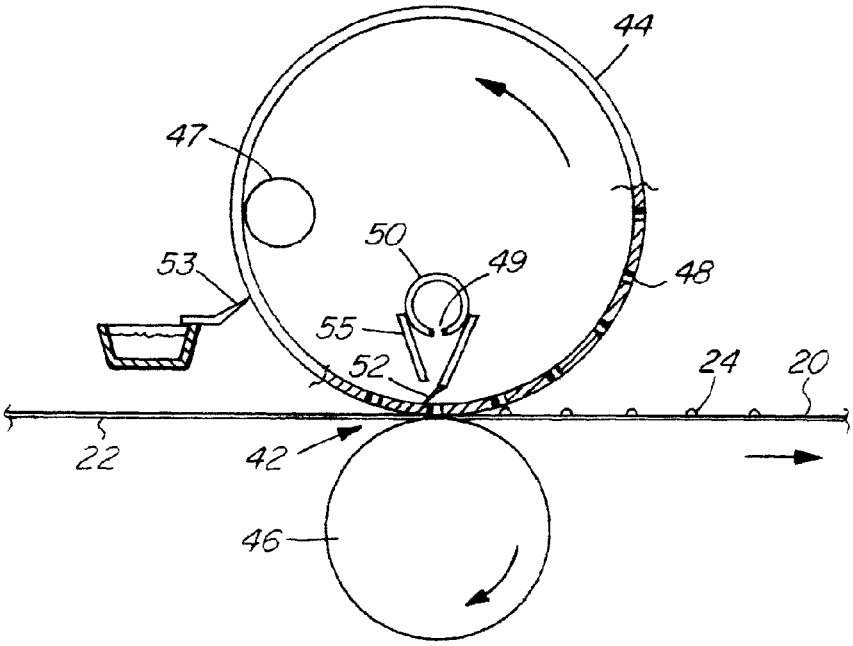
FIG. 3 is a cross-sectional view on the line 3-3 of FIG. 2.

Referring first to FIG. 1, in general terms the process for making the wrap 20 involves processing a substrate 22 by bonding spacer elements 24 to one face 26 of the substrate and drying or curing the spacer elements.

The substrate 22 is a membrane selected to be substantially impermeable to liquid water and air. It may be permeable or impermeable to water vapor. It may be monolithic, non-woven or woven, a single layer or a composite. It may comprise a polymeric resin, including thermoplastic elastomer and polyolefins such as polyethylene and polypropylene. It may be microperforated. The substrate would typically have a thickness in the range of about 3 to 22 mil, depending on the structure of the fabric. One example of a suitable substrate is a coated woven fabric comprising a woven scrim coated on one or both sides with a breathable coating, or alternatively coated on one or both sides with a non-breathable coating and then perforated to make it breathable. This structure would typically be either polyethylene or polypropylene and have a thickness in the range of about 3 to 12 mil. Another example of a substrate is a coated non-woven fabric coated on one or both sides with a breathable coating. This structure would typically be either polypropylene or polyethylene, alternatively polyester, and have a thickness in the range of about 6 to 18 mil. Another example of a substrate is a coated non-woven fabric composite containing two or more non-woven base fabrics that are coated or laminated together with a breathable coating. It can optionally include an open scrim or reinforcement laminated inside the composite. This structure would typically be either polypropylene or polyethylene, alternative polyester, and have a thickness in the range of about 10 to 22 mil. Examples of commercially-available substrates that can be used are Titanium (trademark) roofing underlayment supplied by InterWrap Inc. and Tyvek (trademark) housewrap supplied by DuPont.

The substrate 22 is fed from an unwinding roll 40 into a nip 42 between an upper rotatable resin-transfer sleeve 44 and a lower rotatable roll 46 supported by a frame 45. The roll 46 is a driving roller powered by a motor 41 and it rotates the sleeve. The sleeve 44 is a substantially hollow cylinder having a plurality of spaced-apart apertures 48 across its surface. The apertures 48 can be in various patterns, examples of which are shown in FIG. 5.

As best seen in FIGS. 2 and 3, a tray 50 extends through the length of the sleeve, elevated above the bottom of the sleeve. The tray 50 is a cylindrical container, open along a slot or opening 49 extending along its lower side for the resin composition to flow out of the tray and into a V-shaped channel 55, attached to the tray and open at its lower edge, and then into contact with the sleeve. A doctor blade 52 extends along the length of the sleeve from one side of the channel 55 to the inner surface of the sleeve to confine the resin composition within the sleeve and to clean the inner surface of the sleeve and help push the resin through the apertures 48. A second doctor blade 53 contacts the outside of the sleeve to remove excess resin as the sleeve rotates. The sleeve is supported by a support roller 47 inside the sleeve.

A tank 54 contains a fluid resin composition 56. The composition 56 is a solution or emulsion of a polymer resin. Examples of suitable resins include silicone rubber, polyvinyl chloride (PVC), polyolefins such as polyethylene and polypropylene, ethylene vinyl acetate (EVA), and ethylene methyl acrylate (EMA), and combinations thereof. The resin may be modified to promote water flow on its surface. The fluid resin composition 56 may be at room temperature. It is transferred from the tank 54 to the tray 50 inside the sleeve 44 by means of an air transfer unit 58, which pumps the fluid through a transfer pipe 60 to the tray. The composition flows from the tray through the opening 49 and channel 55 into the sleeve and through the apertures 48 across the width of the sleeve, assisted by the doctor blade 52. It is deposited onto the face 26 of the substrate 22 as the substrate travels through the nip 42, forming spaced-apart spacer elements 24 on the substrate, having the shape of the apertures 48. The spacer elements retain their shape before drying or curing by means of the viscosity and surface tension of the resin composition. The spacer elements may have a height of about 0.5 mm or higher, alternatively about 0.5 to 2 mm. Their width may be in the range of about 0.75 to 3 mm. A spacer element having a height of about 1 mm may have a width at its base of about 2 mm or more. In order to resist compression when the primary roof structure or exterior cladding is installed, the spacer elements have a hardness, measured as Shore A hardness, greater than 90 and a tensile elongation less than 50%. The spacer elements are to be sufficiently flexible to resist cracking when the wrap is in roll form, and to let out to their original shape when the roll is undone for installation.

In one embodiment of the method, the wrap 20 is then fed into a drying chamber 62, in which the resin composition of the elements 24 is dried by means of heat. The drying chamber may operate at a temperature of 60-150 degrees C. By the exit of the drying chamber, the elements 24 are securely bonded to the substrate. The wrap is then wound up into a roll on the windup roller 66. Optionally, a cooling unit 65 may be provided after the drying chamber. In another embodiment, a UV-curing unit 64 is provided instead of a drying chamber. The use of drying, cooling and UV-curing units will depend upon the selection of the resin composition 56. For example, where a UV-curable resin is employed, the method would use UV-curing rather than drying. Line speeds may be in the range of 5 to 40 meters per minute, depending on spacer density and height.

The pattern of the spacer elements on the substrate is determined by the pattern of the apertures in the sleeve. The spacer elements may be arranged in such a way that when the wrap 20 is rolled up, the tendency for the spacer elements to overlap is reduced, resulting in a more compact, dense roll. If the elements were allowed to be applied in a straight line, they would tend to overlap, resulting in a roll with a lot of air space. The spacer elements may also be arranged in such a way that drainage paths are available regardless of the orientation of the wrap within the wall or roof. The spacer elements may also be arranged in a pattern that does not allow the edges of the exterior sheathing to press down against the substrate, reducing the gap for the drainage of water.

Figure 4:
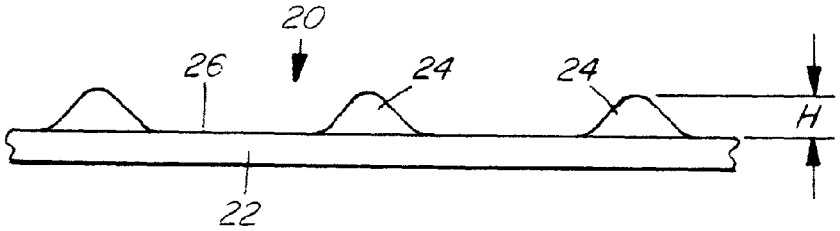
FIG. 4 is a cross-sectional view of the wrap.
Figure 5A:
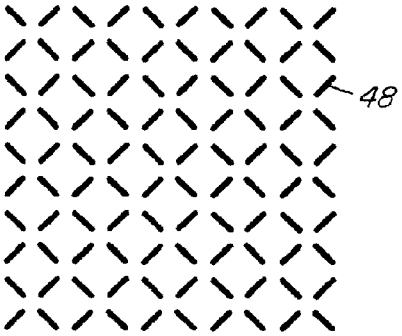
FIGS. 5A to 5I are plan views of representative drainage pattern designs on the sleeve.
Figure 5B:
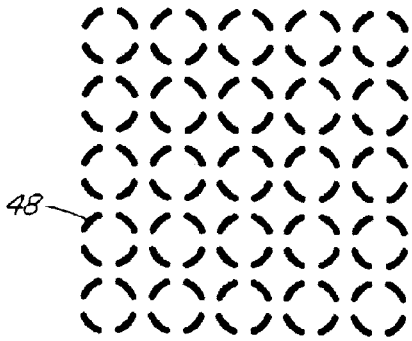
Figure 5C:
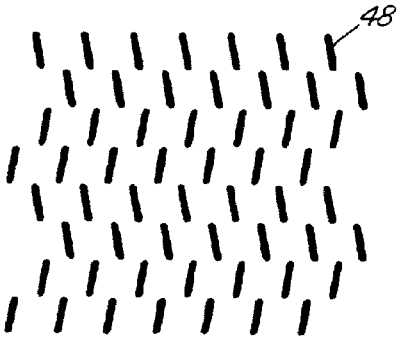
Figure 5D:
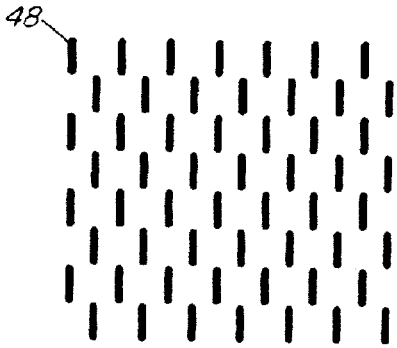
Figure 5E:
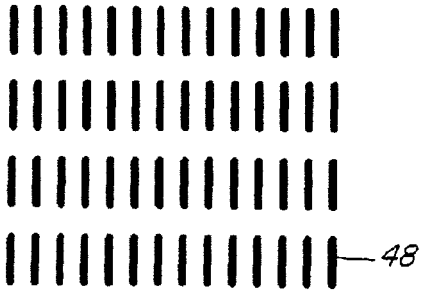
Figure 5F:
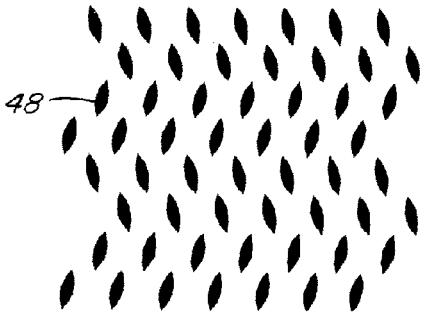
Figure 5G:
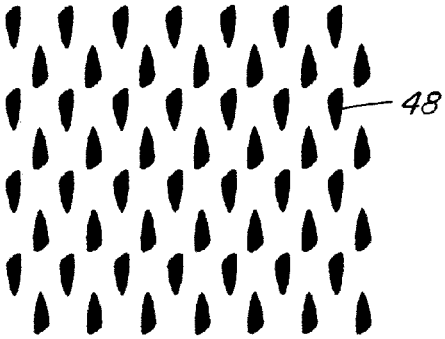
Figure 5H:
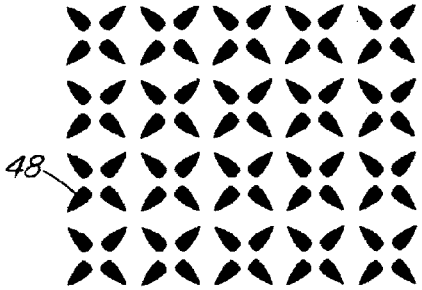
Figure 5I:
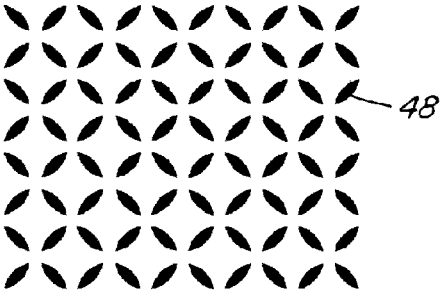

The wrap 20 produced by the foregoing process comprises a weather-resistant, breathable substrate 22 having a plurality of spaced-apart spacer elements 24 on one face 26 of the substrate having a height H, as seen in FIG. 4. In use, the wrap 20 is applied to the inner sheathing of the wall or roof, for example panels of plywood or particle board, with the spacer elements facing out. The exterior sheathing, such as wood siding or shingles, is applied over the wrap, facing the spacer elements. The spacer elements keep the exterior sheathing separated from the face 26 of the substrate by the distance H, forming a gap for the drainage of water.

In a further embodiment of the invention, the spacer elements are applied to both sides of the substrate. This is accomplished by doing a second pass through the apparatus, in which the wrap 20 coated on one side as described above is processed to apply spacer elements to the opposite side. This form of the wrap is used to promote water drainage on both sides thereof.

Example 1

A substrate comprising a water-impermeable, air-impermeable, water vapor-permeable monolithic film of polyethylene having a width of 9 feet (2.7 meters) and a thickness of 4 mils is fed through a production apparatus of the type illustrated in FIGS. 1-3, at a speed of 20 meters per minute. A fluid resin composition comprising silicone rubber is fed at room temperature to the tray. The silicone rubber composition is fed through the apertures in the sleeve and deposited on the membrane as spacer elements having a height of 1 mm and a width of 1.5 mm. The drying chamber is operated at a temperature of 70 degrees C.

Example 2

A fluid resin composition with PVC was prepared by mixing the following materials in an airtight high-speed mixer for about 30 minutes: (a) 10 kg of PVC: MSP-3 PB1302; (b) 5 kg of DOP; (c) 0.5 kg of precipitated silica: A-365-1200; (d) 3 kg of nanometer CaCO3; and (e) 0.2 kg of viscosity reducer: QIBAOSOL-W-3040.

A substrate comprising a water-impermeable, air-impermeable, water vapor permeable monolithic film of polyethylene having a width of 9 feet (2.7 meters) and a thickness of 4 mils was fed through a production apparatus of the type illustrated in FIGS. 1-3, at a speed of 20 meters per minute.

The fluid resin was fed at room temperature to the tray and fed through the apertures in the sleeve and deposited on the membrane as spacer elements having a height of 1 mm and a width of 4 mm. The drying chamber was operated at a temperature of 150 degrees C. The dried spacer elements were determined to have a Shore A hardness in the range of 91-100, and a tensile elongation in the range of 5%-49%.

Example 3

A fluid resin composition with silicone was prepared by mixing the following materials in an airtight high-speed mixer for about 30 minutes: (a) 10 kg of silicone: 5010; (b) 0.2 kg of catalyst: 9600; (c) 0.3 kg of viscosity reducer: QIBAOSOL-W-4040; and (d) 1 kg of nanometer $CaCO_3$.

A substrate comprising a non-woven and a water-impermeable, air-impermeable, water vapor permeable monolithic film of polyethylene having a width of 7 feet (2.1 meters) and a thickness of 4 mils was fed through a production apparatus of the type illustrated in FIGS. 1-3, at a speed of 30 meters per minute. The fluid resin composition was fed at room temperature to the tray and fed through the apertures in the sleeve and deposited on the membrane as spacer elements having a height of 0.8 mm and a width of 2 mm. The drying chamber was operated at a temperature of 115 degrees C.

As will be apparent to those skilled in the art in the light of the foregoing disclosure, many alterations and modifications are possible in the practice of this invention without departing from the scope thereof. The scope of the invention is to be continued in accordance with the following claims.

The invention claimed is:

1. A water drainage-promoting wrap comprising:

a substrate having a first face, a second face, and a plurality of spaced-apart spacer elements on both the first face and the second face;

wherein the substrate is a membrane permeable to water vapor and substantially impermeable to liquid water and to air;

wherein the spacer elements have a height of 0.5 mm or greater, a Shore A hardness greater than 90, and a tensile elongation less than 50%;

wherein the spacer elements are configured to define a gap between one of the first face and the second face of the substrate and an exterior sheathing applied over the water drainage-promoting wrap for the drainage of water.

* * * * *